US007201190B2

(12) United States Patent
Warning

(10) Patent No.: US 7,201,190 B2
(45) Date of Patent: Apr. 10, 2007

(54) FLUID FILL HOOK UP ASSEMBLY FOR A RECREATIONAL VEHICLE

(75) Inventor: Anthony Warning, Elkhart, IN (US)

(73) Assignee: D&W Incorporated, Elkhart, IN (US)

( * ) Notice: Subject to any disclaimer, the term of this patent is extended or adjusted under 35 U.S.C. 154(b) by 0 days.

(21) Appl. No.: 10/970,431

(22) Filed: Oct. 21, 2004

(65) Prior Publication Data

US 2006/0086390 A1 Apr. 27, 2006

(51) Int. Cl.
*F16L 3/00* (2006.01)

(52) U.S. Cl. ..... 137/899; 137/355.12; 137/355.16; 137/335.28; 137/377

(58) Field of Classification Search ..... 137/899, 137/355.12, 355.16, 355.28, 377
See application file for complete search history.

(56) References Cited

U.S. PATENT DOCUMENTS

| | | | | |
|---|---|---|---|---|
| 2,780,430 | A | 2/1957 | Pokryfke | |
| 3,091,251 | A * | 5/1963 | Hughey | 137/355.28 |
| 3,749,118 | A | 7/1973 | Berg | |
| 3,774,630 | A | 11/1973 | Prange | |
| 5,800,002 | A | 9/1998 | Tiedge et al. | |
| 6,186,166 | B1 | 2/2001 | Myers | |
| 6,772,793 | B2 | 8/2004 | Warning | |

OTHER PUBLICATIONS

Supercoil System, "SuperCoil. It's a Snap to use et al.", 2001, 2 pages.
Ocean Equipment, "HoseCoil: The hose that puts itself away", undated, 1 page.

* cited by examiner

*Primary Examiner*—A. Michael Chambers
(74) *Attorney, Agent, or Firm*—Baker & Daniels LLP

(57) ABSTRACT

A plumbing apparatus includes a housing having first and second opposite ends and defining an interior volume therebetween and an inlet fitting connected to the housing and connectable to a fluid source external to the housing. In one embodiment, the plumbing apparatus may also include an outlet fitting connected to the housing, disposed on the exterior thereof and in fluid communication with the inlet fitting; and a hose assembly receivable in the housing for storage, with one end thereof connected to the inlet fitting, and the other end of the hose assembly connectable to the fluid source. The plumbing apparatus may further include a cover member to cover one of the ends of the housing. The cover member may be operable between a closed position preventing access to the interior volume and an open position allowing access to the interior volume. The hose assembly may include a female fitting on said end connectable to the fluid source. The plumbing apparatus may further include a fluid line interconnecting the inlet fitting and the outlet fitting. The housing may further include an end cap covering the end of the housing opposite the end having the covering member. The end cap may include an aperture extending therethrough, with the fluid line interconnecting the inlet fitting and the outlet fitting extends through the aperture in the end cap. The plumbing apparatus may also include a flange mounted around the end of the housing having the cover member. The housing is configured to mount in an opening in a side wall of a recreational vehicle with the flange mounted around the opening adjacent the side wall. The flange may include a plurality of holes for use in mounting the plumbing apparatus. The outlet fitting may include a check valve.

24 Claims, 6 Drawing Sheets

FLUID FILL HOOK UP ASSEMBLY FOR A RECREATIONAL VEHICLE

BACKGROUND OF THE INVENTION

This invention relates generally to accessories for recreational vehicles, and in particular, to a plumbing apparatus to hook up an external water supply to provide water for use in the recreational vehicle.

Various types of vehicles are used and sold for recreational purposes and commercial purposes. When referred to herein, recreational vehicles or commercial vehicles shall refer to motor homes, travel trailers, campers and the like, as well as water craft, such as pleasure boats and pontoons. For example, a typical recreational vehicle is shown in U.S. Pat. No. 5,800,002, which is incorporated herein by reference, and discloses a motor driven style motor home having an interior living area defined by outer walls, including side walls along both sides. Recreational vehicles (RVs) and marine craft carry a supply of fresh water for the convenience of the vehicle occupants while using the vehicle.

In order to provide a supply of fresh water, most recreational vehicles house a fresh water supply tank. In order to fill the fresh water supply tank, most recreational vehicles have a water inlet line connected from the tank to a fitting having a cover that is accessible from the exterior of the recreational vehicle. Typically, a hose, such as an ordinary garden hose, can be used to fill the tank at the fitting. Filling the fresh water tank of the recreational vehicle with a hose, however, can be an inconvenient task. For example, if accessing a faucet at a campground, a hose must be pulled from storage and then connected to the shore side faucet. Also, the cover must be removed from the fluid inlet line fitting so that the hose can be connected thereto.

Furthermore, it is common in recreational vehicles to provide a hook up so that pressurized water from an external source such as city water or from a well can be used, when available and the vehicle is parked, instead of pumping water from the recreational vehicle's water storage tank. Hooking up to a pressurized system provides the same inconveniences as filling the recreational vehicle's water storage tank. In addition, the hook up must also provide a connection that will contain the water or fluid pressure.

Accordingly, a need exists for an apparatus that allows for hooking up to an external pressurized water source or filling the fresh water supply tank in a convenient manner. In addition, it would be beneficial to provide a more convenient storage device for the filling hose that is easily accessible. These and other objects of the present invention have been accomplished.

SUMMARY OF THE INVENTION

It is a feature of the invention to provide a plumbing apparatus that in one embodiment includes an elongate housing having first and second opposite ends and defining an interior volume therebetween and an inlet fitting connected to the housing and connectable to a fluid source external to the housing. The plumbing apparatus may also include an outlet fitting connected to the housing, disposed on the exterior thereof and in fluid communication with the inlet fitting; and a hose assembly receivable in the elongate housing for storage, with one end thereof connected to the inlet fitting, and the other end of the hose assembly connectable to the fluid source.

The plumbing apparatus may further include a cover member to cover one of the ends of the housing. The cover member may be operable between a closed position preventing access to the interior volume and an open position allowing access to the interior volume. The hose assembly may include a female fitting on the end connectable to the fluid source. The plumbing apparatus may further include a fluid line interconnecting the inlet fitting and the outlet fitting. The housing may further include an end cap covering the end of the housing opposite the end having the covering member. The end cap may include an aperture extending therethrough, and the fluid line interconnecting the inlet fitting and the outlet fitting extends through the aperture in the end cap.

The plumbing apparatus may also include a flange mounted around the end of the housing with the cover member. The housing is configured to mount in an opening in a side wall of a recreational vehicle with the flange mounted around the opening adjacent the side wall. The flange may include a plurality of holes for use in mounting the plumbing apparatus.

The outlet fitting may include a check valve.

It is also a feature of the invention to provide an embodiment of a plumbing apparatus for providing pressurized fluid to a plumbing system of a recreational vehicle or filling a fluid storage tank of a recreational vehicle that includes a housing having first and second opposite ends and defining an interior volume therebetween; an inlet fitting contained in the housing and connectable to a fluid source external to the housing; and an outlet fitting disposed on the exterior of the housing and in fluid communication with the inlet fitting and the plumbing system or fluid storage tank in the recreational vehicle. The plumbing apparatus may also include a cover member to cover the first end of the housing wherein the cover member is operable between a closed position preventing access to the interior volume and an open position allowing access to the interior volume.

The plumbing apparatus may further include a hose assembly receivable in the housing for storage. The hose assembly may have one end connected to the inlet fitting and a second end connectable to the fluid source external to the housing.

The plumbing apparatus may further include an end cap covering the second end, wherein the end cap includes an aperture therethrough. The plumbing apparatus may further include a fluid line interconnecting the inlet fitting and the outlet fitting, wherein the fluid line extends through the aperture in the end cap. The plumbing apparatus may further include a check valve on the inlet fitting.

The plumbing apparatus may further include a flange attached to the housing at the first end, wherein the housing is configured to be mountable in an opening in a side wall of the recreational vehicle, and the flange is configured to be mountable about the opening in the recreational vehicle.

The housing of the plumbing apparatus may have a cylindrical configuration.

It is another feature of the invention to provide an embodiment of a vehicle with a plumbing apparatus for connecting to an external fluid source wherein the vehicle includes side walls with an opening through one of the side walls; a fluid storage system; a plumbing system; a housing received in the opening of the side wall with the housing having an exterior end and an opposite interior end defining an interior volume therebetween; and an inlet fitting located in the interior volume. The vehicle may also include an outlet fitting in fluid communication with the inlet fitting and connected to the plumbing system or fluid storage system; and a hose, receivable in the housing for storage.

The housing of the vehicle may further include a flange at the exterior end and surrounding the opening, wherein the flange includes a plurality of mounting holes and a cover attached to the flange that is operable between a closed position preventing access to the interior volume and an open position allowing access to the interior volume.

The hose may have one end connected to the inlet fitting and a second end connectable to an external fluid source. The vehicle may further include a fluid line interconnecting the inlet fitting and the outlet fitting, wherein the fluid line extends through an aperture in the housing. The housing of the vehicle may also include an end cap with the aperture and wherein the outlet fitting is disposed on the exterior of the housing.

The housing of the vehicle may have a cylindrical configuration.

BRIEF DESCRIPTION OF THE DRAWINGS

The above-mentioned and other features and objects of this invention and the manner of obtaining them will become more apparent and the invention itself will be better understood by reference to the following description of an embodiment of the present invention taken in conjunction with the accompanying drawings, wherein.

Figure 1:
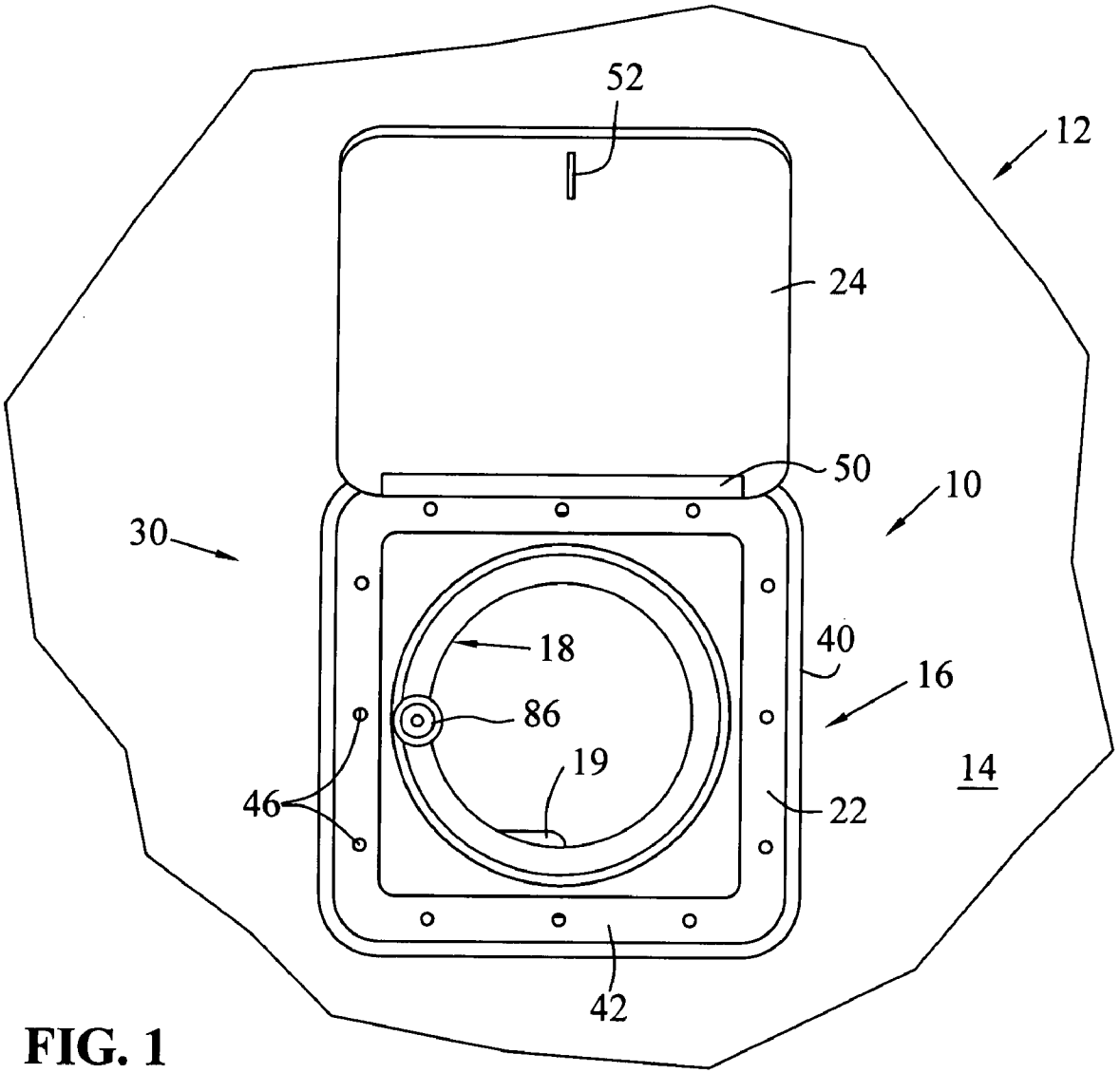
FIG. 1 is a front view of the hookup assembly mounted in the side wall of a recreational vehicle.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
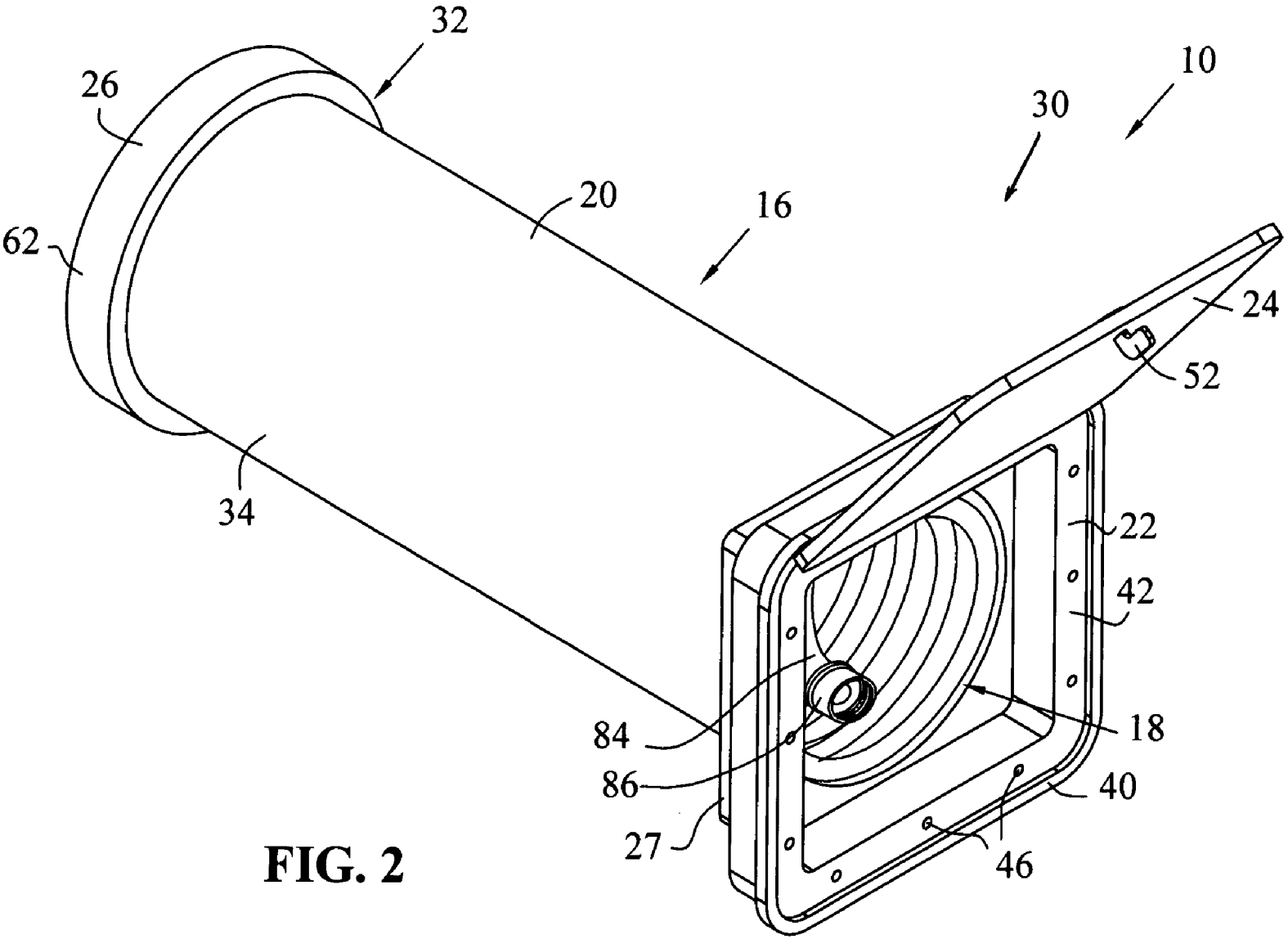
FIG. 2 is a perspective view of the hookup assembly of FIG. 1 removed from the recreational vehicle and with access door open.

Referring to FIGS. 1 and 2, an embodiment of the invention is shown wherein a plumbing apparatus for use in hooking up a recreational vehicle to an external water or other fluid supply for providing pressurized fluid to plumbing system or filling a tank of the recreational vehicle is generally indicated as 10. The recreational vehicle is generally indicated as 12 and includes a side wall 14. Recreational vehicle 12 may be any type of known vehicle including a motor home, a travel trailer, a fifth wheel, or also a marine vehicle.

Figure 8:
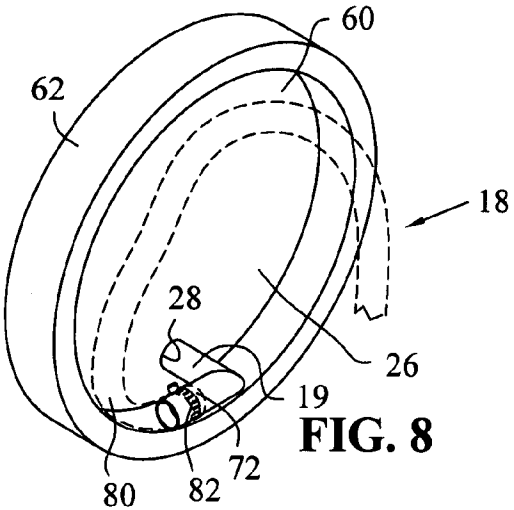
FIG. 8 is a front perspective view similar to FIG. 7 of the end cap but with a filling hose attached thereto and shown in phantom lines.

Plumbing apparatus 10 includes a housing assembly generally indicated as 16, and a hose assembly generally indicated as 18. Hose assembly 18 is connected to a fluid line 19 as shown in FIG. 8.

Housing assembly 16 includes a housing body 20, a mounting flange 22, a cover 24 hinged to flange 22, an end cap 26, and a rectangular portion 27. End cap 26 forms the rear end closure of housing body 20 and includes an aperture 28 to provide an exit point from housing assembly 16 for fluid line 19. Housing body 20, in the embodiment shown, has a tubular cylindrical configuration with a front end generally indicated as 30, a rear end generally as 32, and a side wall 34. Mounting flange 22 includes a front extension portion 40, a recessed surface 42, a rear mounting face 44, and a plurality of mounting holes 46 extending between recess surface 42 and rear mounting face 44. Recessed surface 42 of mounting flange 22 is connected to rectangular portion 27.

Figure 3:
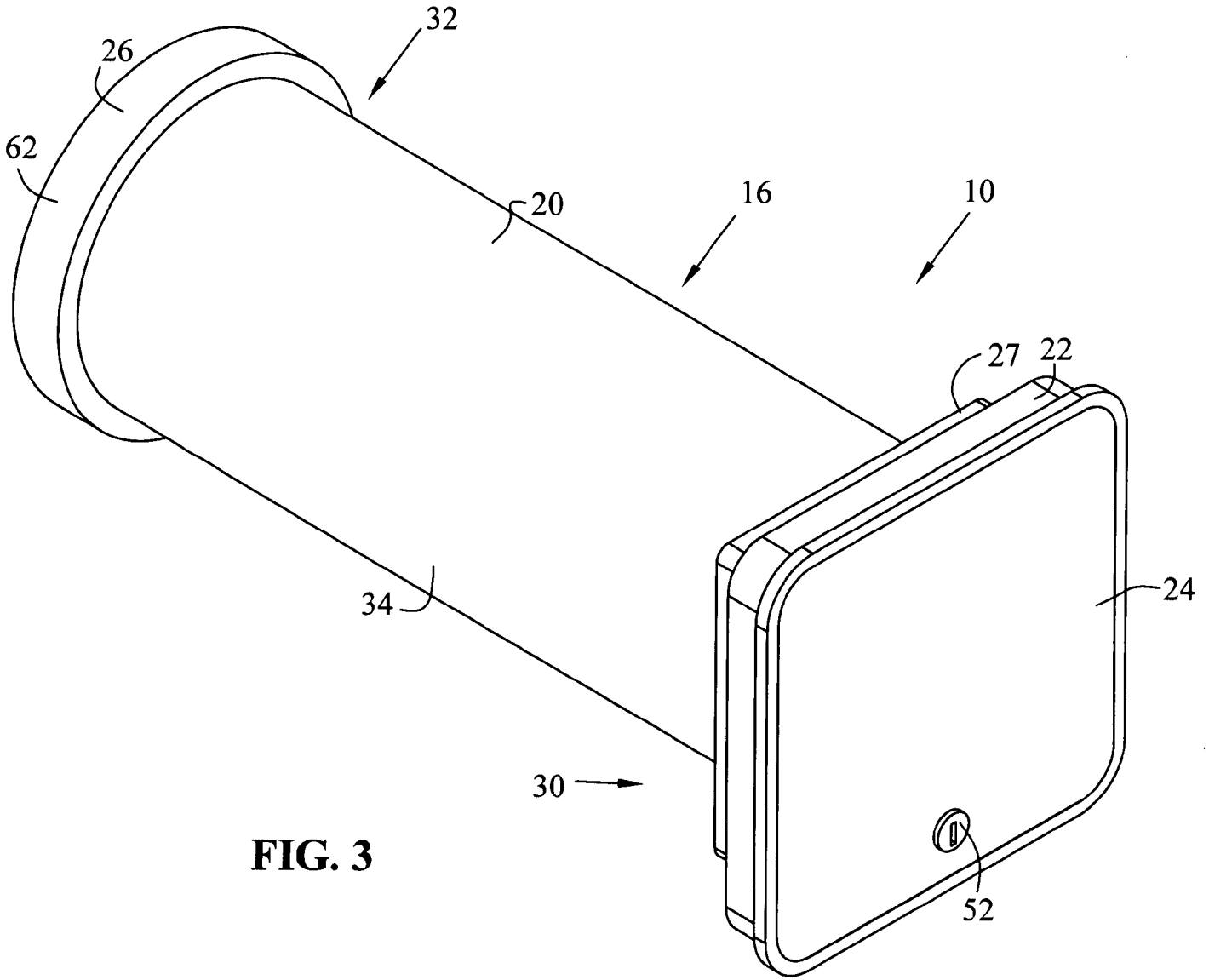
FIG. 3 is a perspective view similar to FIG. 2 with the access door closed.
Figure 4:
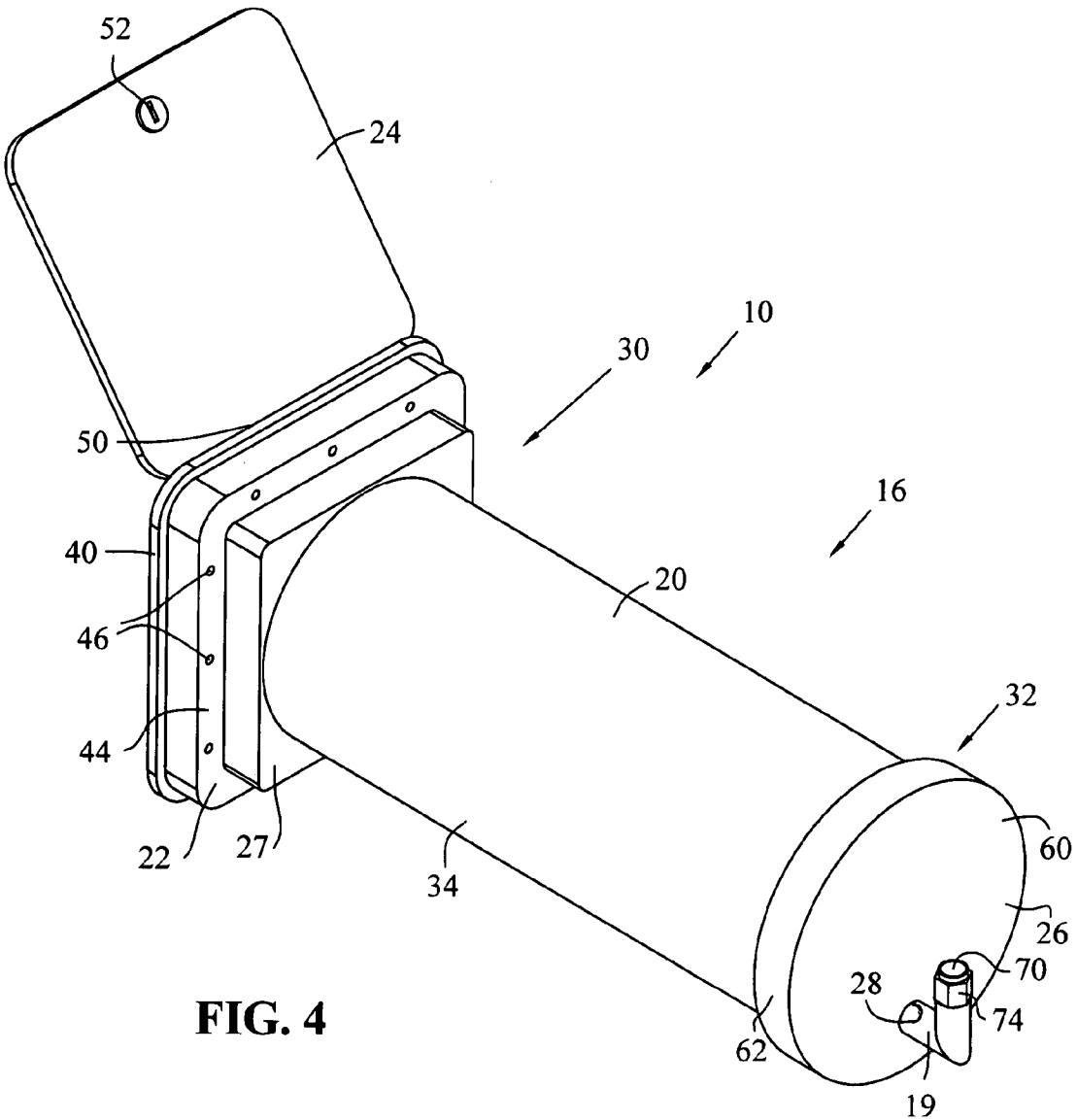
FIG. 4 is a rear perspective view of a hookup assembly with the access door open.
Figure 5:
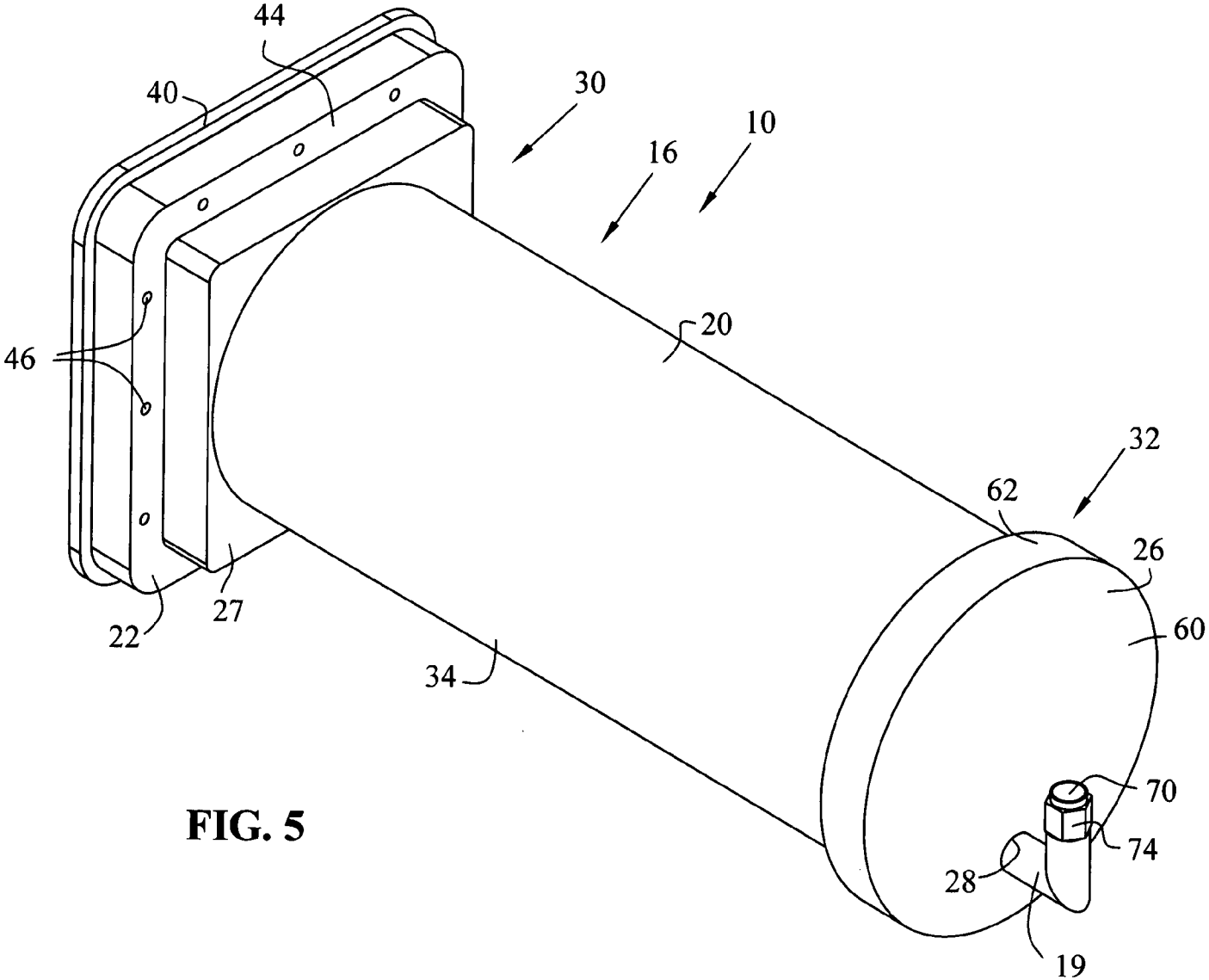
FIG. 5 is a rear perspective view of the hookup assembly with the access door closed.

With reference to FIGS. 1, 2 and 4, cover 24 is hinged to flange 22 at a hinge 50, and further includes a locking latch 52, which operates to lock the cover closed as shown in FIGS. 3 and 5 when the plumbing apparatus is not in use. Flange 22/rectangular portion 27 and end cap 26 may be attached to housing body 20 by use of an adhesive, a plurality of fasteners (not shown) or using other known ways of attachment. In the embodiment shown, end cap 26 includes a substantially flat base portion 60 through which aperture 28 extends through and a flange portion 62 extending generally perpendicular to base portion 60 and is configured to fit around side wall 34 of housing assembly 16.

Figure 7:
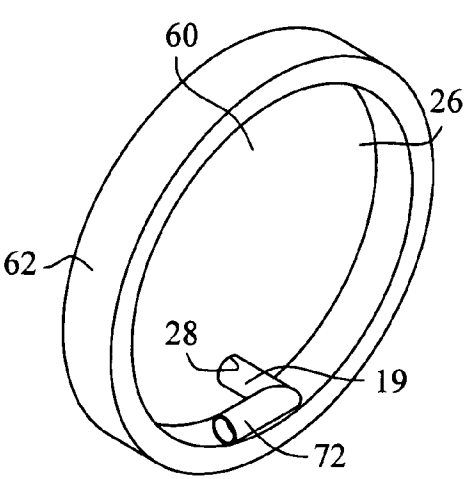
FIG. 7 is a front perspective view of the end cap of FIG. 6.
Figure 6:
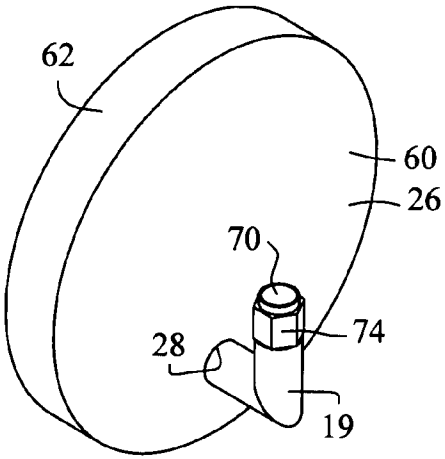
FIG. 6 is a rear perspective view of an end cap removed from the assembly.

With respect to FIGS. 6–8, fluid line 19 will be described in greater detail. Fluid line 16 includes an outlet fitting 70 at one end thereof, and an inlet fitting 72 attached at the other end. As discussed above, fluid line 19 extends through aperture 28 in end cap 26 and may be held in place by adhesives, a threaded connection or securing members such as nuts and washers (not shown). A check valve (not shown), which is well known, can be attached to outlet fitting 70 to prevent reverse fluid flow from the recreational vehicle's fluid storage tank and out of inlet fitting 72. Also, in the embodiment shown, outlet fitting 70 may include a compression fitting 74 for attachment to a fluid line (not shown) that is external to housing assembly 16 and which may be connected to the recreational vehicle's water or other fluid storage tank (not shown) for use in filling the same or for providing pressurized fluid for use in the recreational vehicle. In one embodiment, fluid line 19 may be a PVC-type tube, although it is appreciated that any type of fluid line may be employed.

With reference to FIGS. 1, 2 and 8, hose assembly 18 will be discussed in greater detail. The hose assembly is preferably a precoiled-type hose, as is known, for ease in storing the hose assembly in housing assembly 16. One end 80 of hose assembly 18 is connected to inlet fitting 72 of fluid line 19. In the embodiment shown, a hose clamp 82, as is well known, is used to attach end 80 of hose assembly 18 to inlet fitting 72. The other end 84 of hose assembly 18 includes a female fitting 86 for attachment to an external fluid source such as a threaded male nozzle (not shown). The couplings on the hose assembly 18 are shown for purposes of illustration only and not intended to limit the invention.

It should be appreciated that as assembled, plumbing apparatus 10 may be mounted in an opening through side wall 14 of recreational vehicle 12. The unit is mounted through the opening in the side wall, and fasteners (not shown) may be used to secure the assembly in place. It should be appreciated that the opening is cut through side wall 14, such that it is larger than the profile of housing body 20 and rectangular portion 27 of housing assembly 16, but smaller than the profile of mounting flange 22. Fasteners may be inserted through holes 46 and fastened to side wall 14 or a mounting bracket (not shown) thereon. It should also be appreciated that outlet fitting 70 is connected to the plumbing system of the vehicle by way of a corresponding mating fitting (not shown) to supply water or other fluid to a storage tank (not shown) in the vehicle or to provide pressurized fluid that can be directly used in the vehicle. It should also be appreciated that housing body 20 may be an elongate member, such that hose assembly 18 may be readily stored in housing assembly 16 as shown in FIGS. 1 and 2. When needed for use, end 84 of hose assembly 18 may be pulled out for connecting the hose assembly to a fluid source using fitting 86.

While the invention has been taught with specific reference to the above descriptions and attached figures, one skilled in the art will recognize that changes can be made in form and detail without departing from the spirit and scope of the invention. For example, any suitable configuration, such as a rectangular shape, may be used in place of the cylindrical housing body 20 disclosed in the drawings. In addition, any suitable types, configurations, and materials may be used for hose assembly 18, fluid line 19, and the fittings/couplings. As such, the described embodiments are to be considered in all respects only as illustrative and not restrictive. The scope of the invention, is therefore, indicated by the following claims and equivalents thereof rather than by the description or figures.

What is claimed is:

1. A plumbing apparatus comprising:

an elongate housing having first and second opposite ends and defining an interior volume therebetween;

an inlet fitting connected to and disposed on the interior of said housing and connectable to a fluid source external to said housing;

an outlet fitting connected to said housing, disposed on the exterior thereof, and in fluid communication with said inlet fitting; and a hose assembly receivable in said elongate housing for storage, and one end thereof connected to said inlet fitting on the interior of said housing, and the other end of said hose assembly including a third fitting that is female and simultaneously and directly connectable to a male outlet fitting through which fluid is provided from the fluid source so that fluid enters the end of said hose having said female fitting and exits the other end of said hose connected to the inlet fitting.

2. The plumbing apparatus of claim 1, wherein said housing further includes a cover member to cover one of said ends of said housing, said cover member operable between a closed position preventing access to said interior volume and an open position allowing access to said interior volume.

3. The plumbing apparatus of claim 1, wherein said hose assembly includes a female fitting on said end connectable to the fluid source.

4. The plumbing apparatus of claim 2, further including a fluid line interconnecting said inlet fitting and said outlet fitting.

5. The plumbing apparatus of claim 4, wherein said housing further includes an end cap covering the end of said housing opposite the end having the covering member.

6. The plumbing apparatus of claim 5, wherein said end cap includes an aperture extending therethrough.

7. The plumbing apparatus of claim 6, wherein said fluid line interconnecting said inlet fitting and said outlet fitting extends through said aperture in said end cap.

8. The plumbing apparatus of claim 1, including a flange mounted around the end of said housing having said cover member.

9. The plumbing apparatus of claim 8, wherein said housing is configured to mount in an opening in a side wall of a recreational vehicle with said flange mounted around the opening adjacent the side wall.

10. The plumbing apparatus of claim 9, wherein said flange includes a plurality of holes for use in mounting the plumbing apparatus.

11. The plumbing apparatus of claim 1, wherein said outlet fitting includes a check valve.

12. A plumbing apparatus for providing pressurized fluid to a plumbing system in a recreational vehicle or filling a fluid storage tank of the recreational vehicle, the plumbing apparatus comprising:

a housing having first and second opposite ends and defining an interior volume therebetween;

an inlet fitting contained in said housing and connectable to a fluid source external to said housing;

an outlet fitting disposed on the exterior of said housing and in fluid communication with said inlet fitting and the plumbing system or fluid storage tank in the recreational vehicle;

a fluid line interconnecting said inlet fitting and said outlet fitting and extending through a wall of said housing; and a cover member to cover said first end of said housing, said cover member being operable between a closed position preventing access to said interior volume and an open position allowing access to said interior volume, said fluid line receiving fluid entering said housing through said first end with said cover member in the open position, and the fluid entering said fluid line at said inlet fitting and exiting through said outlet fitting.

13. The plumbing apparatus of claim 12, further including a hose assembly receivable in said housing for storage.

14. The plumbing apparatus of claim 13, wherein said hose assembly has one end connected to said inlet fitting and a second end connectable to the fluid source external to the housing.

15. The plumbing apparatus of claim 12, further including an end cap covering said second end, said end cap including an aperture therethrough.

16. The plumbing apparatus of claim 15, wherein said fluid line extends through said aperture in said end cap.

17. The plumbing apparatus of claim 16, further including a check valve on said inlet fitting.

18. The plumbing apparatus of claim 12, further including a flange attached to said housing at said first end, the housing configured to be mountable in an opening in a side wall of the recreational vehicle, and said flange configured to be mountable about the opening in the recreational vehicle.

19. The plumbing apparatus of claim 12, wherein said housing has a cylindrical configuration.

20. A vehicle with a plumbing apparatus for connecting to an external fluid source, the vehicle comprising:

vehicle side walls with an opening through one of said side walls;

a fluid storage system;

a plumbing system;

a housing received in said opening of said side wall, said housing having an exterior end and an opposite interior end defining an interior volume therebetween;

an inlet fitting located in said interior volume;

an outlet fitting in fluid communication with said inlet fitting and connected to the plumbing system or fluid storage system; and a hose, receivable in said housing for storage, a first end of said hose having a fitting engaging and connected to said inlet fitting, and a second end of said hose connectable to the fluid source external to the vehicle so that fluid flows in said second end of said hose from the external fluid source and out said first end of said hose into said inlet fitting and out said outlet fitting to the plumbing system or fluid storage system of the vehicle.

21. The vehicle of claim 20, wherein said housing further includes a flange at said exterior end and surrounding said opening, said flange including a plurality of mounting holes and a cover attached to said flange, said cover operable between a closed position preventing access to said interior volume and an open position allowing access to said interior volume.

22. The vehicle of claim 20, further including a fluid line interconnecting said inlet fitting and said outlet fitting, said fluid line extending through an aperture in said housing.

23. The vehicle of claim 22, wherein said housing further includes an end cap, said aperture being located in said end cap and said outlet fitting disposed on the exterior of said housing.

24. The vehicle of claim 20, wherein said housing has a cylindrical configuration.

* * * * *